US011668067B2

(12) United States Patent
Nyqvist

(10) Patent No.: US 11,668,067 B2
(45) Date of Patent: Jun. 6, 2023

(54) LIFTING ARRANGEMENT AND LOADING MACHINE FOR UNDERGROUND APPLICATIONS

(71) Applicant: EPIROC ROCK DRILLS AKTIEBOLAG, Örebro (SE)

(72) Inventor: Stefan Nyqvist, Örebro (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 463 days.

(21) Appl. No.: 16/755,243

(22) PCT Filed: Oct. 23, 2018

(86) PCT No.: PCT/SE2018/051077
§ 371 (c)(1),
(2) Date: Apr. 10, 2020

(87) PCT Pub. No.: WO2019/088895
PCT Pub. Date: May 9, 2019

(65) Prior Publication Data

US 2020/0240104 A1 Jul. 30, 2020

(30) Foreign Application Priority Data

Oct. 31, 2017 (SE) ..... 1751353-2

(51) Int. Cl.
*E02F 3/34* (2006.01)
*E02F 9/22* (2006.01)
*E21C 41/00* (2006.01)

(52) U.S. Cl.
CPC ..... *E02F 3/3408* (2013.01); *E02F 9/2203* (2013.01); *E21C 41/00* (2013.01)

(58) Field of Classification Search
CPC ..... E02F 3/3408
See application file for complete search history.

(56) References Cited

U.S. PATENT DOCUMENTS 253,060 A 1/1882 Johnson et al.
2,685,342 A 8/1954 Lauck
(Continued)

FOREIGN PATENT DOCUMENTS

DE 1067730 B 10/1959
GB 822362 A 10/1959

OTHER PUBLICATIONS

International Search Report and Written Opinion in corresponding International Application No. PCT/SE2018/051077 dated Dec. 17, 2018 (10 pages).

*Primary Examiner* — Michael S Lowe
(74) *Attorney, Agent, or Firm* — Sage Patent Group

(57) ABSTRACT

A includes a control arm comprising a first link and a second link, a lift arm articulately connected to the first link by a first joint and a first actuating means articulately connected to the first link by the second joint. The second link and the lift arm are adapted to permit a pivotal connection with a loading means by a third joint and a fourth joint, wherein the lift arm is adapted to lift and lower the loading means and the first actuating means is adapted for actuating the control arm, by acting on the first link in at least a direction from the first actuating means, to achieve a rotational movement of the loading means around said fourth joint, when the loading means is connected to the control arm and to the lift arm. During action of the first actuating means on the first link in the direction from the first actuating means a decrease of a distance between the second joint and the third joint is achieved.

11 Claims, 3 Drawing Sheets

(56) References Cited

U.S. PATENT DOCUMENTS

| | | | | |
|---|---|---|---|---|
| 2,707,056 | A | 4/1955 | Gerst | |
| 2,773,613 | A | 12/1956 | Burrus | |
| 2,783,903 | A | 3/1957 | Beyerstedt | |
| 2,789,711 | A | 4/1957 | Burrus | |
| 2,820,555 | A | 1/1958 | Lessmann | |
| 2,852,869 | A | 9/1958 | Beyerstedt | |
| 2,853,200 | A | 9/1958 | Beyerstedt | |
| 2,959,306 | A | 11/1960 | Kampert | |
| 3,048,287 | A | 8/1962 | Biedess | |
| 3,171,557 | A | 3/1965 | Bosredon | |
| 3,220,580 | A | 11/1965 | Long | |
| 3,411,647 | A | 11/1968 | Zimmerman | |
| 4,029,226 | A * | 6/1977 | Seaberg | E02F 3/3408 414/696 |
| 4,134,506 | A | 1/1979 | Simmons | |
| 4,364,705 | A | 12/1982 | Shumaker | |
| 6,099,236 | A | 8/2000 | Wiechman | |
| 6,755,604 | B1 * | 6/2004 | Schaeff | E02F 3/308 414/706 |
| 2007/0217899 | A1 | 9/2007 | Sakada | |
| 2014/0341690 | A1 | 11/2014 | Kim et al. | |
| 2016/0245083 | A1 | 8/2016 | Rubie | |

* cited by examiner

LIFTING ARRANGEMENT AND LOADING MACHINE FOR UNDERGROUND APPLICATIONS

CROSS-REFERENCE TO RELATED APPLICATIONS

This application is a U.S. National Stage application of PCT/SE2018/051077, filed Oct. 23, 2018 and published on May 9, 2019 as WO2019/088895, which claims the benefit of Swedish Patent Application No. 1751353-2, filed Oct. 31, 2017, all of which are hereby incorporated by reference in their entireties.

TECHNICAL FIELD

The invention concerns underground applications, for example within mining industry. The invention concerns especially a lifting arrangement and a loading machine for underground applications.

BACKGROUND

Loading machines intended for use in a mine environment need to meet high standards to be able to operate in the demanding environment in a mine. For instance, it is required that the construction of the machine manage to withstand high loads and enable the machine to operate within limited spaces.

The document U.S. Pat. No. 3,048,287 describes a rock loading machine comprising a boom structure adapted to control a bucket when loading a material directly onto a conveyor.

The document U.S. Pat. No. 4,134,506 describes a machine adapted for loading soil and comprises a bucket and arms arranged to achieve a compact construction. The bucket is designed with recesses to receive a part of the wheels of the machine in a retracted position of the bucket.

Despite the known solutions within the field, there is a need to further develop a lifting device and a machine for underground applications.

SUMMARY

One object of the invention is to provide an improved lifting device and a machine for underground applications.

The object is achieved according to an aspect of the invention by a lifting arrangement adapted to be mounted at a loading machine for underground applications. The lifting arrangement comprises: a control arm comprising a first link and a second link. The lifting arrangement comprises also a lift arm articulately connected to the first link by a first joint. The lift arm is thereby connected to the first link by the first joint so that the lift arm may rotate in relation to the first link around the first joint. Further, the first link may also rotate in relation to the lift arm around the first joint.

The lifting arrangement comprises also a first actuating means articulately connected to the first link by the second joint. Thereby, the first actuating means is connected to the first link so that the first link and the first actuating means may rotate in relation to each other around the second joint.

The second link and the lift arm are adapted to permit a pivotal connection with a loading means by a third joint and a fourth joint respectively. With other words, the loading means may be connected to the second link and to the lift arm by the third joint and the fourth joint respectively so that the loading means, the second link and the lift arm may rotate in relation to each other around the third joint and around the fourth joint respectively.

The lift arm is adapted to lift and lower the loading means when the loading means is connected to the lift arm. In this way, the position of the loading means in relation to the ground may be changed by using the lift arm when the loading means is connected to the lift arm.

The first actuating means is adapted for actuating the control arm by acting on the first link. The first actuating means is thereby adapted to generate a force by which the first actuating means may act on the first link to rotate the first link around the first joint. Because the control arm comprises the first link, the control arm may be controlled and regulated in an efficient way by using the first actuating means acting on the first link.

The first actuating means is adapted to act on the first link in at least a direction from the first actuating means. The direction from the first actuating means refers to a direction when, at a fixed position of at least one point on the actuating means in this direction, an increase of a distance between the second joint and the at least one point is achieved. Thereby, the second joint may be pushed from the at least one point of the first actuating means, in the fixed position in said direction from the first actuating means.

The lifting arrangement is arranged so that during action of the first actuating means in the at least the direction from the first actuating means a rotational movement of the loading means around the fourth joint is achieved. This is achieved when the loading means is connected to the control arm and to the lift arm. Thereby, the loading means may be turned around the fourth joint by using the first actuating means and by using the control arm.

The first link and the lift arm are arranged to rotate around the first joint to achieve the rotational movement of the loading means around the fourth joint or to lift and lower the loading means respectively. Thus, both the first link and the control arm may rotate around one and the same joint. Thereby, the number of components of the lifting arrangement is reduced, which simplifies the construction of the lifting arrangement. Further, the weight of the lifting arrangement may also be reduced thanks to fewer components of the lifting arrangement.

Because, the first link and the lift arm are arranged to rotate around the first joint, the lift arm may rotate around the first joint at the same time as the first link may retain its position. Thereby, the loading means may be lifted or may be lowered in an effective way by using the lifting arrangement without need of lifting or lowering of the first link and the control arm. In this way an effective lifting arrangement is achieved by which heavier loads may be handled because the first link and the control arm do not need to be lifted and lowered when lifting and lowering of the loading means.

Further, during action of the first actuating means on the first link in the direction from the first actuating means a decrease of a distance between the second joint and the third joint is achieved. Thus, a movement of the second joint in a direction towards the third joint is achieved when the first actuating means acts on the first link in the direction from the first actuating means. Further, a movement of the third joint towards the second joint may be achieved when the first actuating means acts on the first link in the direction from the first actuating means. Thereby, the loading means may be turned in a direction towards the second joint, when the loading means is connected to the control arm and to the lift arm, and when the first actuating means acts on the first link in the direction from the first actuating means. Thus, the loading means may be turned in a direction towards the second joint while the second joint is pushed from the at least one point at the first actuating means in the fixed position in said direction from the first actuating means.

The first actuating means may be designed so that a larger force from the first actuating means may be achieved at acting in the direction from the first actuating means. This in contrast to when acting in a direction towards the first actuating means. Thereby, at action of the first actuating means in the direction from the first actuating means a larger force may be achieved, acting on the first link, which facilitates the operation of the control arm and thereby the loading means.

Thus, an improved lifting arrangement is provided comprising fewer components. Fewer components may result in that the weight of the lifting arrangement may be reduced. Reduced weight of the lifting arrangement may result in that a higher load may be handled by a load machine with the lifting arrangement mounted on the machine. Furthermore, a lifting arrangement is provided which enables the use of simpler actuating means.

Thereby, the object mentioned above is achieved.

As an alternative the first joint may be arranged so that a lever is achieved at action of the first actuating means on the first link. Then, the first joint may be placed within the first link and in relation to the second joint so that a distance between the first joint and the second joint is achieved. With a lever, the operation of the control arm is facilitated because lower forces from the first actuating means are required to operate the control arm and a loading means that has been connected to the control arm.

The first link and the second link may be articulately connected with each other by a fifth joint. As an alternative, the first joint may be arranged between the second joint and the fifth joint. For example, the first joint may be arranged along a line between the second joint and the fifth joint.

The first joint may be arranged substantially at the middle of the first link. Thereby, the distance between the first joint and the second joint may be substantially the same as the distance between the first joint and the fifth joint. In this way, at action of the first actuating means on first link, an even distribution of forces from the first actuating means on the first link may be achieved.

The first actuating means may comprise a hydraulic cylinder, wherein the action on the first link in the direction from the first actuating means comprises pressurizing of a plus side of the hydraulic cylinder.

The lifting arrangement may comprise a second actuating means articulately connected with the lift arm. Thereby, the lift arm may be controlled by using the second actuating means while the second actuating means and the lift arm may rotate in relation to each other.

The lifting arrangement may be adapted to be mounted at a frame of the loading machine by the first joint. Thereby, the lifting arrangement may be attached to the loading machine in a simple manner by the first joint. In this way, the number of components needed for attachment of the lifting arrangement to the frame may be reduced. Further, because the lift arm and the first link are articulately connected by the first joint, both the first link and the lift arm may be mounted at the frame by the first joint so that a rotation of the first link and lift arm in relation to the frame may be achieved. As an additional advantage, a higher flexibility when it comes to the placement of the attachment of the lifting arrangement at the frame may be achieved thanks to that the lifting arrangement may be mounted at the frame by the first joint. The lifting arrangement may for example be mounted at a front part of the frame.

The first joint may comprise a bolt. Thereby, a simple first joint may be achieved.

The lift arm may be substantially straight. In this way, the lift arm may be designed as one piece and without some significant bends along the extent of the lift arm. Thus, the lift arm may be designed as a shorter arm and with lower weight. A substantially straight lift arm implies that the lift arm may withstand higher loads, especially when it comes to bending. With a shorter lift arm, the weight of the lifting arrangement may be reduced. Further, an improved lifting arrangement may be provided for use in limited spaces such as in a mine.

The loading means may comprise a bucket.

Another object of the invention is to provide an improved machine for underground applications.

This object is achieved according to an additional aspect of the invention by a loading machine for underground applications comprising said lifting arrangement.

The lifting arrangement comprises fewer and simpler components comparing to known solutions. The lifting arrangement can be made with lower weight. The lifting arrangement may also withstand higher loads and may be mounted at the frame of a machine at an advantageous location. Further, the compact construction of the lifting arrangements gives advantageous when it comes to use in limited spaces.

Because the loading machine for underground applications may comprise the lifting arrangement as above, an improved loading machine for underground applications may be achieved.

Thus, a loading machine for underground applications is provided that may achieve the object described above.

According to an embodiment the first joint may be arranged substantially directly above a wheel axle of the loading machine. With substantially directly above is meant that a substantially vertical line may pass through the first joint and wheel axle.

Because the lifting arrangement may be mounted at the frame of a loading machine by the first joint, at least a part of the weight of the lifting arrangement may be carried by the first joint. The first joint is also adapted to be able to carry the weight of the loading means including a material in the loading means.

Thus, at least a part of the weight of the lifting arrangement, the weight of the loading means and the weight of the material in the loading means may be carried by the frame through the first joint.

Because the first joint may be arranged substantially directly above the wheel axle of the loading machine, an improved load- and weight distribution is achieved that may improve the stability of the loading machine. Further, the frame of the loading machine may be dimensioned lighter because a substantial part of among other the weight of the lifting arrangement, the weight of the loading means and the weight of the material in the loading means may be carried by the wheel axle.

BRIEF DESCRIPTION OF THE DRAWINGS

The various aspects of the subject matter, including their particular features and advantages, will be readily understood from the following detailed description and the accompanying drawings, in which.

DETAILED DESCRIPTION

The embodiments herein will now be described in more detail with reference to the accompanying drawings, in which example embodiments are shown. Disclosed features of example embodiments may be combined. Like numbers refer to like elements throughout.

Figure 1:
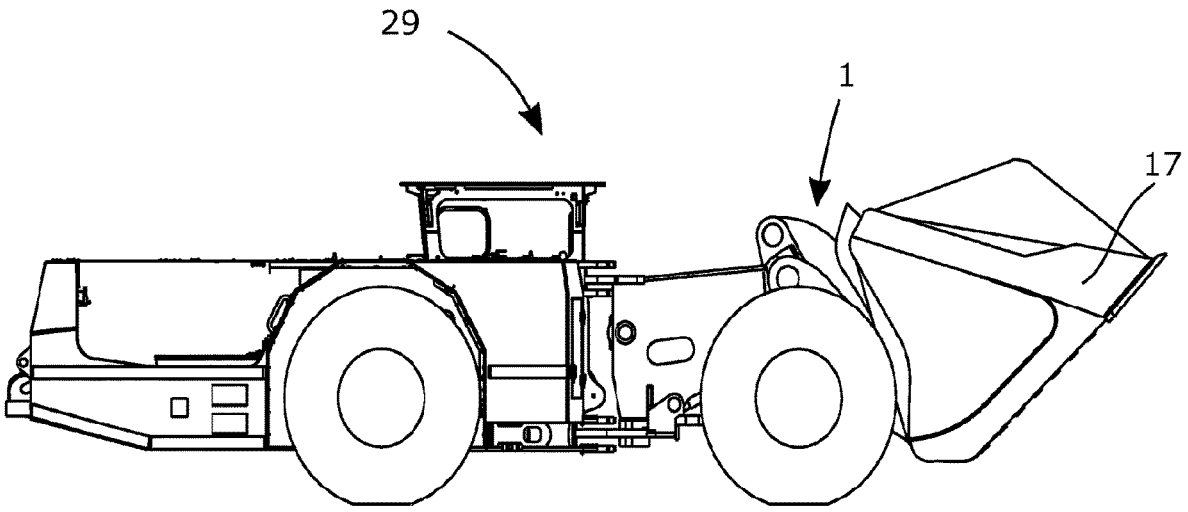
FIG. 1 shows a loading machine for underground applications comprising a lifting device.

FIG. 1 illustrates a loading machine 29 for underground applications comprising a lifting arrangement 1 and bucket 17 that has been mounted at the lifting arrangement 1. According to some embodiments, loading forks or other organs for handling of load or material, may be mounted at the lifting arrangement 1. FIG. 1 illustrates the lifting arrangement 1 in a position when the bucket 17 has been turned upwards and has been lifted from the ground. In this position and location of the bucket 17, the loading machine 29 is ready for transport.

Figure 2:
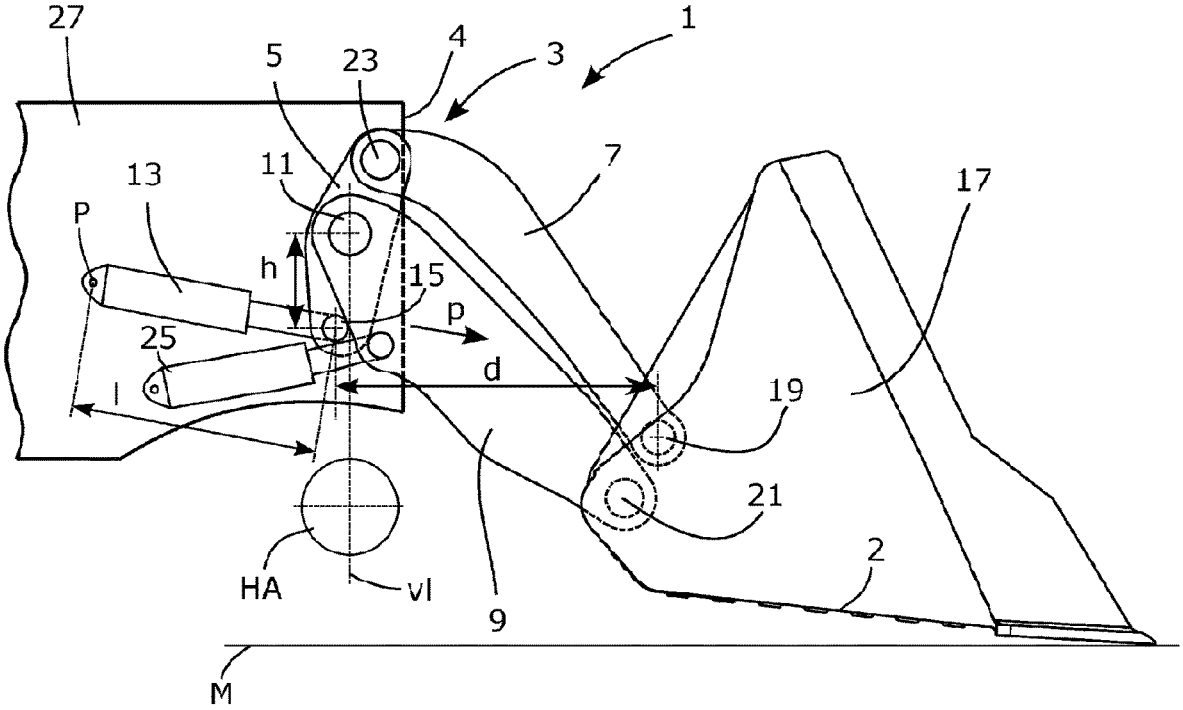
FIG. 2 shows the lifting device in FIG. 1 in a first position and FIG. 3 shows the lifting device in FIG. 1 and FIG. 2 in a second position.

FIG. 2 illustrates the lifting arrangement 1 in FIG. 1 in a first position, when the bucket 17 that has been connected to the lifting arrangement may be used for loading of a material such as earth mass, stones or similar.

The lifting arrangement 1 comprises a control arm 3 comprising a first link 5 and a second link 7. The first link 5 and the second link 7 may have different forms. For example, the first link 5 and the second link may be substantially straight or may be formed as a "C", i.e. may be curved.

The lifting arrangement 1 comprises also a lift arm 9 articulately connected to the first link 5 by a first joint 11. Thereby, the lift arm 9 may rotate in relation to the first link 5 around the first joint 11. Further, also the first joint 5 may rotate in relation to the lifting arm 9 around the first joint 11.

With a joint is meant a coupling between at least two different elements that provides a rotational movement of the two different elements in relation to each other. In a similar way, a articulated connection that elements articulately connected to each other may rotate in relation to each other.

The second link 7 and lifting arm 9 are adapted so that the bucket 17 may be connected to the lifting arrangement 1 through a third joint 19 and a fourth joint 21 respectively. The second link 7 and lift arm 9 may comprise opening with diameters that correspond diameters of openings in the bucket adapted to cooperate with each other in order to achieve the third joint 19 and the fourth joint 21. This, by bolts with adapted diameters that may be inserted in the openings described above.

The lifting arrangement 1 comprises also a first actuating means 13 articulately connected to the first link by the second joint 15. The first actuating means 13 may comprise a hydraulic cylinder or a pneumatic cylinder. The cylinders may be connected to a hydraulic system or to an air system (not shown) to provide a control of the cylinders. The control of the cylinders is done in a known way and is therefore not described in details here.

The function of the control arm 3 is to rotate the bucket 17 around the fourth joint 21 and in this way to control the angular position of the bucket 17 in relation to the ground, referenced as M in the FIG. 2. Thereby, an angle (not shown) between a plane through the bottom of the bucket and the ground M may be changed when the bucket is rotated around the fourth joint 21.

The function of the lift arm 9 is to lift and to lower the bucket 17 in relation to the ground M.

The actuating means 13 is adapted to control the control arm 3, by acting on the first link 5 in at least a direction p from the first actuating means 13.

The direction p from the first actuating means 13 refers to a direction when, at a fixed position of at least one point P on the actuating means 13 in this direction p, an increase of a distance I between the second joint 15 and the at least one point P is achieved. The distance I between the second joint 15 and the point P may also be called as a length I of the first actuating means 13. With other words, an extension of the first actuating means 13 is achieved when the first actuating means 13 is acting on the first link 5 in the direction p from the first actuating means 13.

Thereby, the second joint 15 may be pushed from the at least one point P of the first actuating means 13. According to embodiments illustrated in FIG. 2, the point P represents an attachment point of the first actuating means 13 at a frame 27. The first actuating means 13 may be attached to the frame 27 at the point P so that the first actuating means may rotate around an axis through the point P in relation to the frame 27. This during action of the first actuating means 13 on the first link 5.

The first link 5 and the lift arm 9 are arranged to rotate around the first joint 11 to achieve the rotational movement of the bucket 17 around the fourth joint 21 and to lift and to lower the bucket 17 respectively. At the action of the first actuating means 13 on the first link 5 in the direction p from the first actuating means 13, a decrease of a distance d between the second joint and the third joint 19 is achieved. With other words, a displacement of the second joint 15 towards the third joint 19 is achieved when the first actuating means 13 is acting on the first link 5 in the direction from the first actuating means 13.

The first joint 11 may be arranged, in relation to the first link 5, so that a lever h is achieved when the first actuating means 13 is acting on the first link 5. Thereby, the first joint 11 may be arranged at a distance from the second joint 15 that corresponds to the length of the lever h. The magnitude of the lever h or the distance between the first joint 11 and the second joint 15 may be decided in advance in order to adapt the lifting arrangement 1 to for, example different sizes of the first actuating means 13 and to different sizes of the bucket 17 or other loading means.

The first link 5 and the second link 7 are articulately connected to each other by a fifth joint 23, wherein the first joint 11 is arranged between the second joint 15 and the fifth joint 23.

As illustrated in FIG. 2, the first joint 11 may be arranged substantially in the middle of the first link 5.

As it has been mentioned above, the first actuating means 13 may comprise a hydraulic cylinder, wherein action on the first link 5 in said direction p from the first actuating means 13 comprises pressurizing of a plus side of the hydraulic cylinder.

Hydraulic cylinders are often designed to enable generation a higher force on the plus side comparing to the minus side. Thereby, simple hydraulic cylinders may be used at the lifting arrangement 1, which simplifies the construction of the lifting arrangement 1.

The lifting arrangement 1 may comprise a second actuating means 25 articulately connected to the lift arm 9 and adapted to lift and to lower the lift arm 9 and thereby the bucket 17. The second actuating means 25 may be of the same kind as the first actuating means 13 as described above, i.e. the second actuating means 25 may comprise a hydraulic cylinder or a pneumatic cylinder.

The lifting arrangement 1 is adapted to be mounted at the frame 27 of the loading machine by the first joint 11 that may comprise a bolt. The length of the bolt is adapted to the width of the first link, to the width of the lift arm and to achieve a safe attachment at the frame. The bolt may be through-going through the frame, for example at a construction of the lifting arrangement that implies two sets of control arms and lift arms.

According to the embodiments in FIG. 2, the lift arm 9 is substantially straight. Thereby the lift arm 9 may be designed as one piece and without some significant bends along the extent of the lift arm 9. Thus, the lift arm 9 may be designed as a shorter arm and with lower weight. A substantially straight lift arm 9 implies that the lift arm may withstand higher loads, especially when it comes to bending. Further, the placement of the lifting arrangement 1 in relation to the frame 27 may be facilitated in case of a straight lift arm 9. According to the embodiments in FIG. 2, the lifting arrangement 1 may be mounted at a front part of the frame 27 and on a short distance from the frame edge 4 of the frame 27, for example on a distance of 30 cm. Thereby, the control arm 3 and the lift arm 9 may be manufactured shorter. As a consequence of this a lighter lifting arrangement 1 may be achieved. The lighter lifting arrangement may result in a lighter loading machine.

Further, as illustrated in FIG. 2, the first joint 11 may be arranged substantially directly above a wheel axle HA of the loading machine. With substantially directly above is meant that a substantially vertical line vl may pass through the middle of the first joint and the middle of the wheel axle HA. Thereby, an improved load—and weight distribution may be achieved that may improve the stability of the loading machine. The first joint 11 may be arranged offset in relation to the wheel axle HA.

Figure 3:
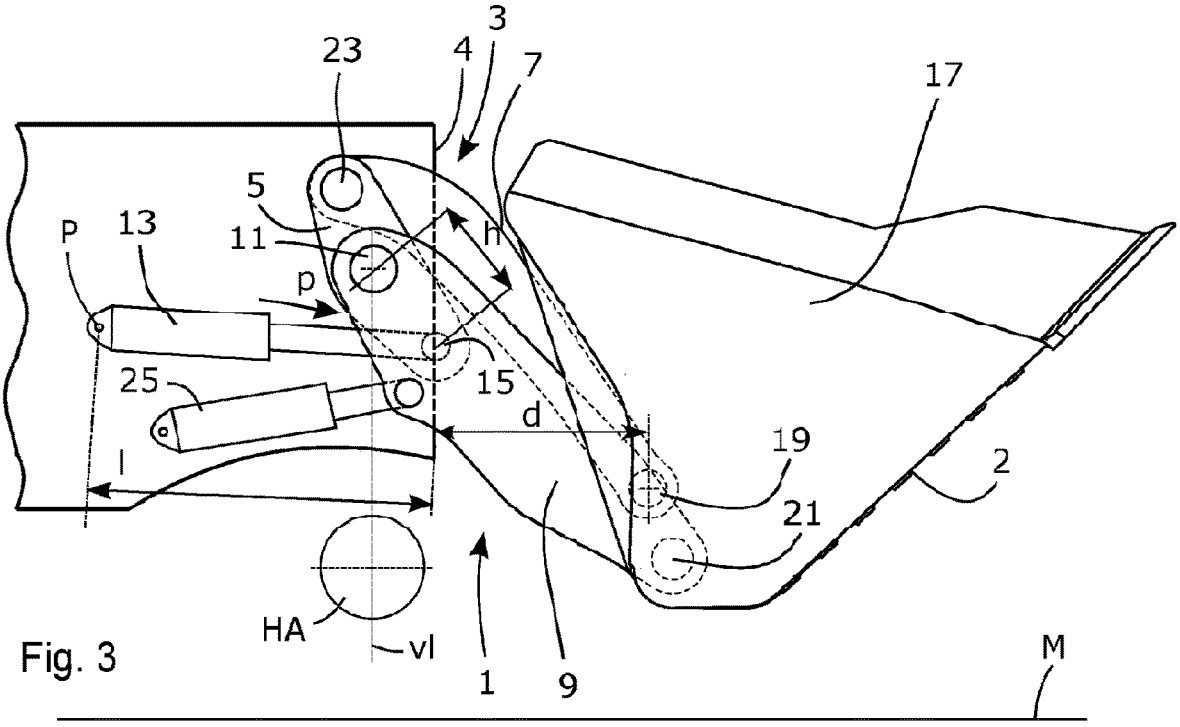

FIG. 3 illustrates the lifting arrangement 1 in the FIG. 1 and in FIG. 2. In FIG. 3 the lifting arrangement 1 is illustrated in a second position, in which bucket 17 that has been connected to the lifting arrangement 1, has been turned upwards and is in a position, for example, for transport.

According to FIG. 3, the first link 5 has been affected of the first actuating means 13 in the direction p from the first actuating means 13. Thereby, the first link 5 has been turned counter clockwise, in FIG. 3, around the first joint 11. As it is illustrated in FIG. 3, the length l of the first actuating means 13 become greater comparing to the position of the lifting arrangement 1 as illustrated in FIG. 2. Since the first link 5 is articulately connected to the second link 7 by the a fifth link 23, the above-described rotation of the first link 5 counter clockwise around the first joint 11 will cause the third joint 19 to move in a direction towards the second joint 15, which will cause the bucket 17 to rotate counter clockwise, in FIG. 3, around the fourth joint 21. Thus, the distance d between the second joint 15 and the third joint 19 will decrease.

The invention claimed is:

1. A lifting arrangement adapted to be mounted at a loading machine for underground applications, the lifting arrangement comprises:

a control arm comprising a first link and a second link, a lift arm articulately connected to the first link by a first joint, a first actuating means articulately connected to the first link by a second joint and a second actuating means articulately connected with the lift arm, wherein the second link and the lift arm are adapted to permit a pivotal connection with a loading means by a third joint and a fourth joint, wherein the lift arm is adapted to lift and lower the loading means and the first actuating means is adapted for actuating the control arm, by acting on the first link in at least a direction from the first actuating means, to achieve a rotational movement of the loading means around said fourth joint, when the loading means is connected to the control arm and to the lift arm, wherein the first link and the lift arm are arranged to rotate around said first joint to achieve said rotational movement of the loading means around said fourth joint respectively to lift and lower the loading means and that during action of the first actuating means on the first link in said direction from said first actuating means a decrease of a distance between the second joint and the third joint is achieved, wherein the first link and the second link are articulately connected with each other by a fifth joint, and wherein a distance between the first joint and the second joint is substantially same as a distance between the first joint and the fifth joint.

2. The lifting arrangement according to claim 1, wherein said first joint is arranged so that a lever is achieved at action of the first actuating means on the first link.

3. The lifting arrangement according to claim 1, wherein the first joint is arranged between the second joint and the fifth joint.

4. The lifting arrangement according to claim 1, wherein said first joint is arranged substantially at the middle of said first link.

5. The lifting arrangement according to claim 1, wherein the first actuating means comprises a hydraulic cylinder, wherein the action on the first link in said direction from the first actuating means comprises pressurizing of a plus side of the hydraulic cylinder.

6. The lifting arrangement according to claim 1, wherein said lifting arrangement is adapted to be mounted at a frame of said loading machine by the first joint.

7. The lifting arrangement according to claim 1, wherein the first joint comprises a bolt.

8. The lifting arrangement according to claim 1, wherein the lift arm is substantially straight.

9. The lifting arrangement according to claim 1, wherein the loading means comprises a bucket.

10. A loading machine for underground applications comprising a lifting arrangement according to claim 1.

11. The loading machine according to claim 10, wherein said first joint is arranged substantially directly above a wheel axle of the loading machine.

* * * * *